US005337687A

United States Patent [19]

Moll

[11] Patent Number: 5,337,687

[45] Date of Patent: Aug. 16, 1994

[54] PROCESS FOR BRINGING TOGETHER, ALIGNING, AND CO-PROCESSING FLACCID WORKPIECE LAYERS

[76] Inventor: Philipp Moll, Königsberger Strasse 74, 5100 Aachen, Fed. Rep. of Germany

[21] Appl. No.: 838,785

[22] PCT Filed: Sep. 18, 1990

[86] PCT No.: PCT/EP90/01589

§ 371 Date: May 4, 1992

§ 102(e) Date: May 4, 1992

[87] PCT Pub. No.: WO91/04365

PCT Pub. Date: Apr. 4, 1991

[30] Foreign Application Priority Data

Sep. 22, 1989 [DE] Fed. Rep. of Germany ..... 3931673

[51] Int. Cl.[5] ..... D05B 21/00; B65H 7/02

[52] U.S. Cl. ..... 112/262.3; 271/228; 270/58; 112/121.12

[58] Field of Search ..... 112/121.12, 262.3; 38/143; 198/409, 395, 376, 377, 80.3, 793, 644, 678.1; 271/228, 184, 185, 225, 227, 228, 241; 270/30, 53, 58; 414/735, 738, 739, 732, 783, 776

[56] References Cited

U.S. PATENT DOCUMENTS 1,997,267 4/1935 Remington ..... 38/143 X
2,264,032 11/1941 Webb ..... 112/262.3
4,433,632 2/1984 Becka et al. ..... 112/262.3
4,917,369 4/1990 Moll et al. ..... 271/228
5,140,919 8/1992 Berington ..... 112/262.3

FOREIGN PATENT DOCUMENTS 0260331 3/1988 European Pat. Off. ..... A41H 43/02

*Primary Examiner*—Clifford D. Crowder
*Assistant Examiner*—Paul C. Lewis
*Attorney, Agent, or Firm*—McGlew and Tuttle

[57] ABSTRACT

A process and device for automatically feeding workpiece layers to be processed in a hanging position in a vertical plane to a scanning and aligning station (R). The workpiece layers are grasped individually in a horizontal starting position, brought into the vertical position, and transferred to the scanning and aligning station (R), from which they are taken over directly after alignment and forwarded to the processing station (N). The device for carrying out this process has two conveyors (F and F'), each of which consists of a feed conveyor (Z; Z') designed as a manipulator and a transport mechanism (T; T') formed by a conveyor belt (48; 48'). The workpiece layers are held by controllably movable clamps (20; 20') in the scanning and aligning station (R). The transport mechanisms (T and T') can be moved to and fro between a carrying position and a non-carrying position in the area of the clamps (20 and 20'). As a result of which the feed conveyors (Z and Z') are able to transfer the workpiece layers to the clamps (20 and 20'), and these the clamps are able to move freely for mutually aligning the workpiece layers.

9 Claims, 4 Drawing Sheets

N
62
63
64
66
65
53
52
49
T2
54
51
57
58
53'
55
56
48b
48a
43
22
48
19
R
20
T
61
T1
60
50
59
48'
F
G
T1'
1
Z
60'
T'
3
1'
Z'
16'
59'
F'
15'
5'
7'
4'
16
15
5
4
7
W1
W2

T2'
48'
49'
52'
48b'
48a'
W2
19
W1
48a
48b
48

PROCESS FOR BRINGING TOGETHER, ALIGNING, AND CO-PROCESSING FLACCID WORKPIECE LAYERS

FIELD OF THE INVENTION

The present invention relates in general to a process and device for bringing together, aligning and co-processing flaccid workpiece layers and specifically to moving layers of fabric from a horizontal position to a vertical position where two layers of fabric to be joined are aligned with each other and then transferred to a processing site where an edge of the two fabrics can be sewn together.

BACKGROUND OF THE INVENTION

A similar process and device are described in European Patent Disclosure Document No. EP-OS 0,260,331.

In the prior-art process, the workpiece layers are fed toward each other by means of conveying means. The conveying means comprise rail-guided carriages on which clamps are arranged that hold the upper end of the workpiece layers. These conveying means have track sections directed in parallel to one another in a scanning station and an aligning station. To make possible the mutual alignment of the workpiece layers, the clamps on the carriages of one of the conveying means are arranged by means of a holding head that is movable in a plurality of directions in relation to the carriage carrying it. This holding head carries a magnetizable plate that comes into frictionally engaged contact, in the aligning station, with a permanent magnet that is fastened to the adjacent carriage of the other conveying means. Using an adjusting device of the stationary aligning station, the movable holding head of the clamps on the first-named carriage is adjusted corresponding to the scanning result so that the two workpiece layers that are located adjacent to one another in the aligning station will reach the predetermined relative position. Due to the frictional engagement between the magnetizable plate on the holding head of one carriage and the permanent magnet on the other carriage, this relative position will be maintained when the two carriages move together from the aligning station into a subsequent processing station after alignment of the workpiece layers.

This design is relatively complicated, because it requires a holding head that is adjustable in a plurality of directions on each of the carriages of one conveying means. In addition, to adjusting the holding heads, the adjusting device must apply a considerable force to produce the specified relative position of the two workpiece layers in order to overcome the frictional force between the magnetizable plate and the permanent magnet, which must, as is explained, be strong enough to maintain the relative position, once set, between the permanent magnet and plate and consequently the aligned position of the workpiece layers.

It is assumed in the prior-art process that the workpiece layers to be brought together are already suspended on the clamps carried by the carriages of the conveying means, and the manner in which this suspension was performed is left open.

SUMMARY AND OBJECTS OF THE PRESENT INVENTION

The basic task of the present invention is to provide a process which makes it possible to automatically feed the workpiece layers to the scanning and aligning station, on the one hand, and is designed, on the other hand, such that this can be carried out with a device of simple design.

The task of the present invention is accomplished by having first and second workpieces lying substantially horizontal on a support table. The first and second workpieces lie side by side and these first and second workpieces are to be joined together, preferably at an edge. The first and second workpieces are grasped from this horizontal support table and moved to a scanning and aligning station. As the first and second workpieces are moved to the scanning and aligning station, they are turned so that the workpieces are substantially vertical and positioned substantially flat opposite each other. The workpieces are positioned at opposite sides of an intermediate plate and are held against this intermediate plate by first and second clamping means, respectively. At least one of the clamping means is movable in order to align at least an edge of one of the workpieces with the edge of the other workpiece. A scanning means operates in cooperation with a clamp movement means in order to move the clamp and therefore align the first and second workpieces. After they have been aligned a transport means grasps the first and second workpieces and slides the first and second workpieces along the intermediate plate. The first and second workpieces are then transported from the scanning and aligning station to a processing site where the first and second workpieces are further processed, preferably by being sewn together.

The operation where the feeding in of the workpiece layers to the scanning and aligning station is combined with the process steps of picking up and bringing into a vertical position makes it possible either to pre-align the workpiece layers to be associated with one another by hand on a supporting table, in which case the workpiece layers are located next to one another and consequently do not influence one another, or to take over the workpiece layers from an output station of a preceding processing machine.

Since the workpiece layers are subsequently transferred to the scanning and aligning station and are then taken over for further transport in the direction of the processing or connection site only after they have been aligned, the workpiece layers are separated during alignment from the conveying means that bring about feeding and removal, so that the alignment can take place independently and uninfluenced by these conveying means. Based on these circumstances, it is guaranteed that the device for carrying out the process can be of a relatively simple design.

In one of the preferred embodiments of the present invention one of the edges of the first and second workpieces are aligned with each other. This edge is substantially perpendicular to a transporting direction in which the transport means transports the aligned workpieces to the processing site. The transport means stops the aligned workpieces at the processing site and a stitch forming machine moves along the aligned edge in order to sew and connect the aligned edge.

This embodiment provides for favorable conditions for the edge-parallel connection of two workpiece layers with highly irregular course of the edges, because the workpiece layers hang down freely from their clamping sites and are therefore able to easily perform relative movements in relation to a stitch-forming machine moved along a straight line.

Another preferred embodiment of the present invention is where the aligned edge of the two workpieces is substantially parallel to the direction of transport of the transport means. The transport means moves the aligned workpieces towards and through the processing site. During the transporting a stitch forming machine connects the aligned edges while the workpieces are in motion.

This preferred embodiment makes it possible to process two pairs of workpiece layers associated with one another with an overlap in time, i.e., in a particularly efficient manner.

The device of the present invention uses first and second grasping plates to grasp the horizontal workpieces from the support table. These first and second grasping plates are pivotably connected to an arm and the arm is pivotably connected to a frame. The arm pivots on the frame to move the workpieces from the support table to the scanning and aligning station. The arm pivots on the frame and the grasping plates pivot on the arm to move the workpieces into a substantially vertical position. Each workpiece has its own first and second grasping plates and arm. At the scanning and aligning station clamp means apply force to the workpieces through cut outs in the grasping plates. At the scanning and aligning station the workpieces are placed against opposite sides of an intermediate plate and first and second clamp means clamp the workpieces against the intermediate plate. An optical scanning means cooperates with a clamp movement means on one of the first and second clamp means in order to align the first and second workpieces. Once the first and second workpieces have been aligned a transport means closes around the first and second workpieces and slides the first and second workpieces by means of a conveyor belt against the intermediate plate and to the processing site. When the arm and grasping plates are moving the workpieces to the aligning station, a first section of the transport means moves away from the intermediate plate in order to allow the arm and grasping plates to move the workpieces to the scanning and aligning station. Once the arms and grasping plates are removed the first section of the transport means can come back together to press the first and second workpieces against the intermediate plate for transporting the first and second workpieces away from the scanning and aligning station after they have been aligned. Deflecting wheels are positioned on the conveyor belt of the transport means in order to separate the first section of the transport means from the remainder of the transport means or a second section of the transport means.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figures 1, 2:
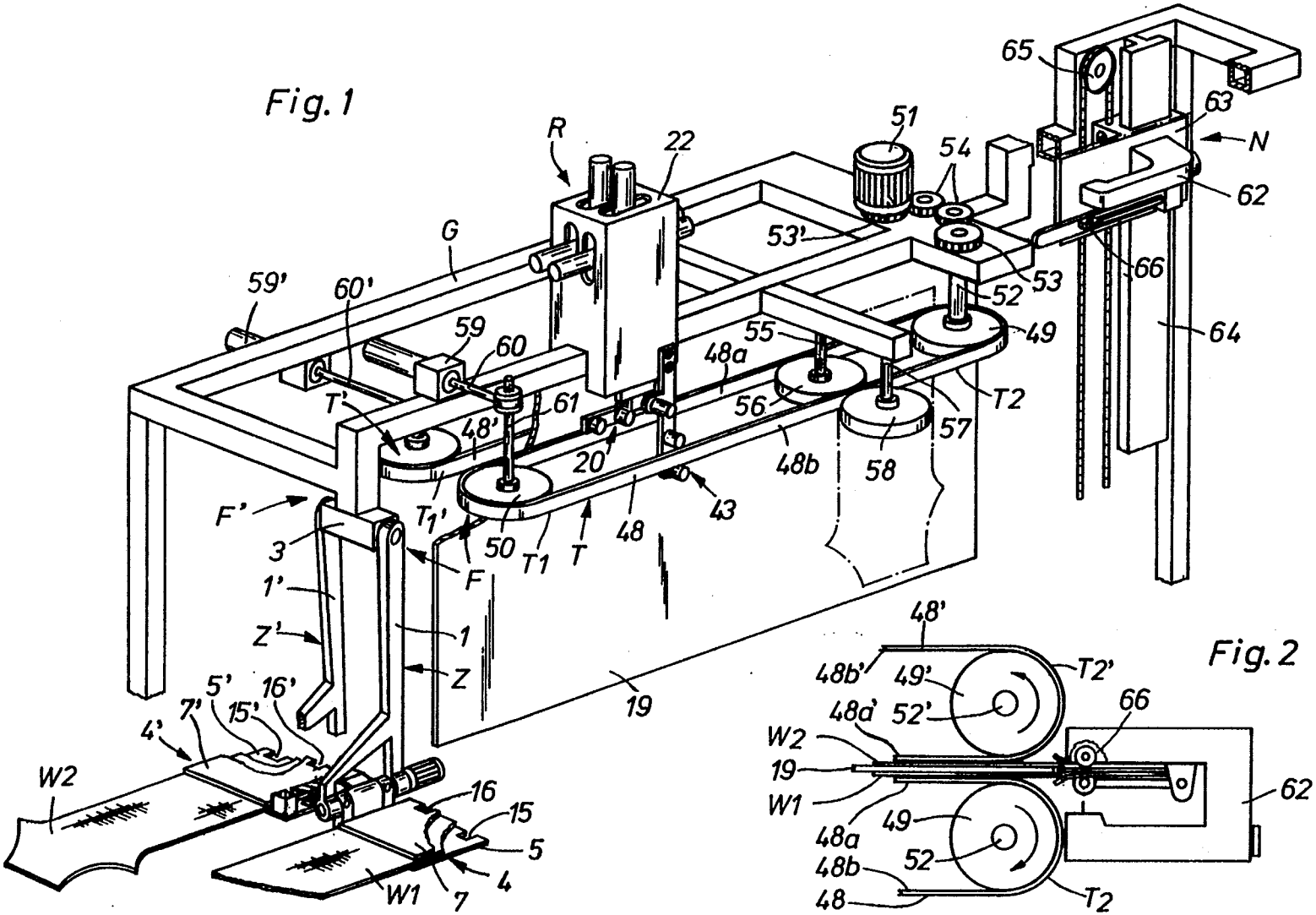
FIG. 1 is a synoptic graphic representation of a device with the characteristics of the present invention.
FIG. 2 is a sectional view from the top as a detail representation of the area around the sewing machine.

The device according to the present invention contains, according to FIG. 1, a plurality of cooperating basic components, namely, a frame G, two conveying means F and F′ arranged next to one another, a scanning and aligning station R, as well as a sewing station N. The conveying means F and F′ comprise a feeding conveyor Z and Z′ respectively, to feed two workpiece layers W1 and W2 to the scanning and aligning station R, as well as a transport mechanism T and T′ respectively to forward the aligned workpiece layers W1 and W2 to the sewing station N.

The feed conveyor Z is designed as a manipulator and has an arm 1. One end of the arm 1 is fastened to the shaft 2 (see FIG. 3) of a gear motor 3 fastened to the frame G and is pivotable around a horizontal axis. The other end of the arm 1 is of a fork-shaped design and carries a gripper 4 designed as a tong. The gripper 4 contains a first (lower, according to FIG. 5) grasping plate 5, which is fastened to a shaft 6 mounted at one end of the arm 1, as well as a second (upper) grasping plate 7, which is pivotably mounted on the shaft 6. A pneumatic cylinder 9, whose piston rod 10 is hinged to a projection 11 of the second grasping plate 7, is hinged to a projection 8 of the first grasping plate 5.

The shaft 6 is in driven connection with a rotary magnet 12 fastened to the arm 1. By the rotary magnet, the grasping plates 5 and 7 are jointly pivotable around the longitudinal axis A2 of the shaft 6, and the longitudinal axis A2 extends at right angles to the longitudinal extension of the arm 1 and in parallel to its plane of pivoting.

A plurality of flat ribs 14 extending in parallel to the plane of pivoting of the arm 1 are provided on the underside of the first grasping plate 5. The two grasping plates 5 and 7 have a plurality of openings or cutouts 15 and 16, respectively, which extend to the discharge-side edges of the plates, wherein the openings 15 of the first grasping plate 5 are aligned with the openings 16 of the second grasping plate 7. The word "discharge" describes the edge of the grasping plates 5 and 7 over which the workpiece layer W1 is pulled off at the time of transfer to the scanning and aligning station R.

Figure 5:
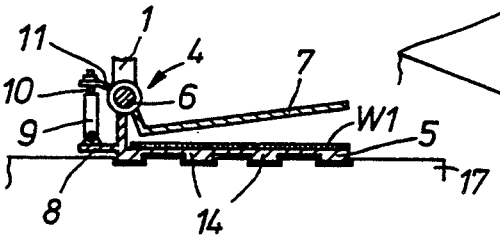
FIG. 5 is a sectional view of a gripper, with which one workpiece layer is removed from a supporting table.

The workpiece layer W1, which is to be grasped by the gripper 4, is laid on an essentially horizontally extending supporting table 17. The supporting table 17 may be the delivery end of an upstream processing device, e.g., the cooling station of a fixing machine. On the top side of the supporting table 17, a plurality of openings 18 are provided, and they extend substantially in parallel to the discharge-side edge of the supporting table. The openings 18 receive the ribs 14 of the first grasping plate 5 when the gripper 4 is in the pickup position (FIG. 5). A corresponding beveling of the front, intake-side edge zone of the grasping plate 5 makes it possible, when the gripper 4 is in the pickup position (FIG. 5), at least for the beveled edge zone to be flush with the top side of the supporting table 17 The workpiece W1 to be placed on the supporting table 17 cannot strike and be caught by the front edge of the grasping plate 5. Instead the workpiece W1 will be spread out flat, and over and beyond this edge and even on to the grasping plate 5. If desired, it would also be possible to design the first grasping plate as a fork-shaped plate, so that not only the front, feed-side edge zone, but the entire grasping plate would be flush with the top side of the supporting table 17.

Figure 3:
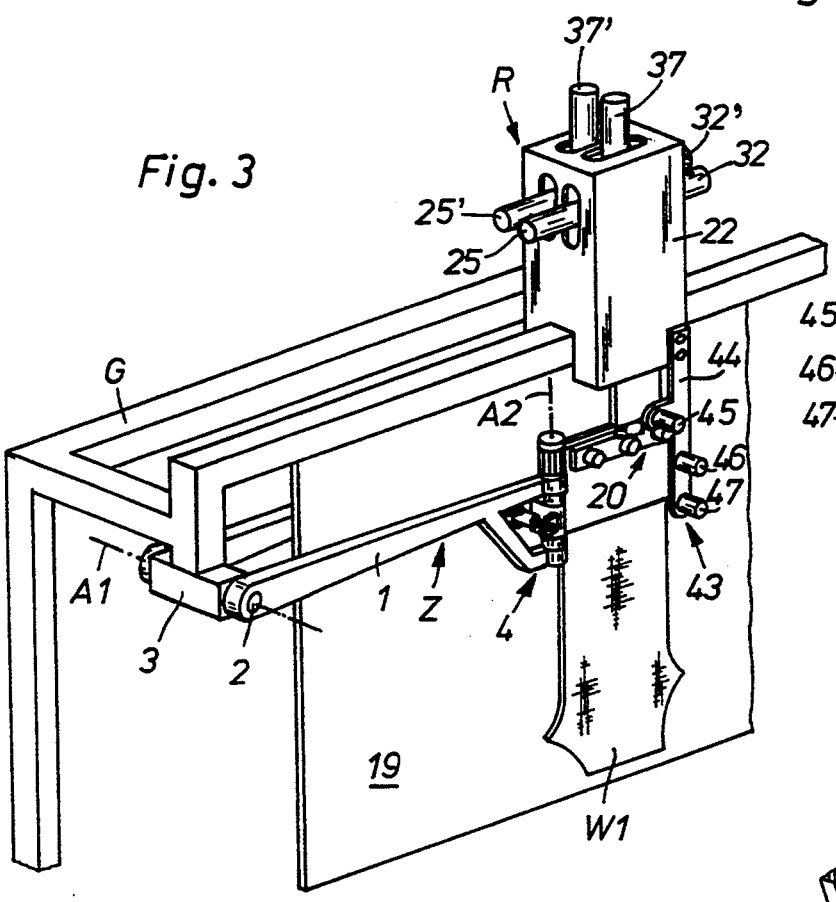
FIG. 3 is a detail similar to FIG. 1, in which the transfer of one workpiece layer to the scanning and aligning station is shown.
Figure 6:
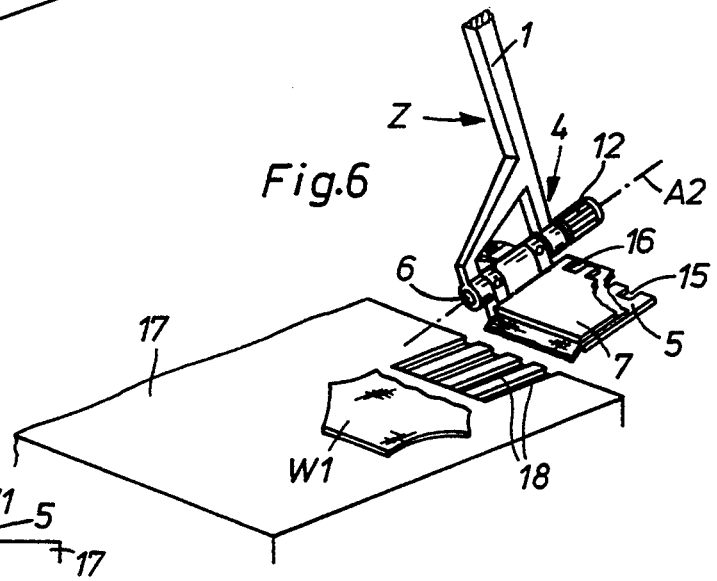
FIG. 6 is a graphic representation of a detail from the area of the supporting table during the transfer of one workpiece layer into the scanning and aligning station.

As is apparent from a comparison of FIGS. 1, 3, and 6, the workpiece layer W1 is transferred by means of the above-described feed conveyor Z by two superimposed pivoting movements. The workpiece W1 moves from the horizontal top side of the supporting table 17 into a hanging position, in which the workpiece layer is made available to the scanning and aligning station R. During the pivoting movement of the arm 1 around the axis A1, the workpiece layer W1 is brought from the horizontal into the vertical position, and at the same time pivoted by pivoting the gripper 4 around the axis A2. The workpiece then is finally located in the extension of the arm, as is shown in FIG. 3.

It should be noted here that the feed conveyor Z' of the conveying means F' is essentially identical to the above-described feed conveyor Z. Therefore, identical components are designated by the same reference numerals, and the reference numerals for the feed conveyor Z' differ from the reference numerals used for the feed conveyor Z only by a prime sign (').

It should be noted in this connection that the same gear motor 3 is used to pivot the arm 1' as to pivot the arm 1. This is achieved by the gear motor 3 having a continuous shaft 2 and consequently two outputs.

Figure 7:
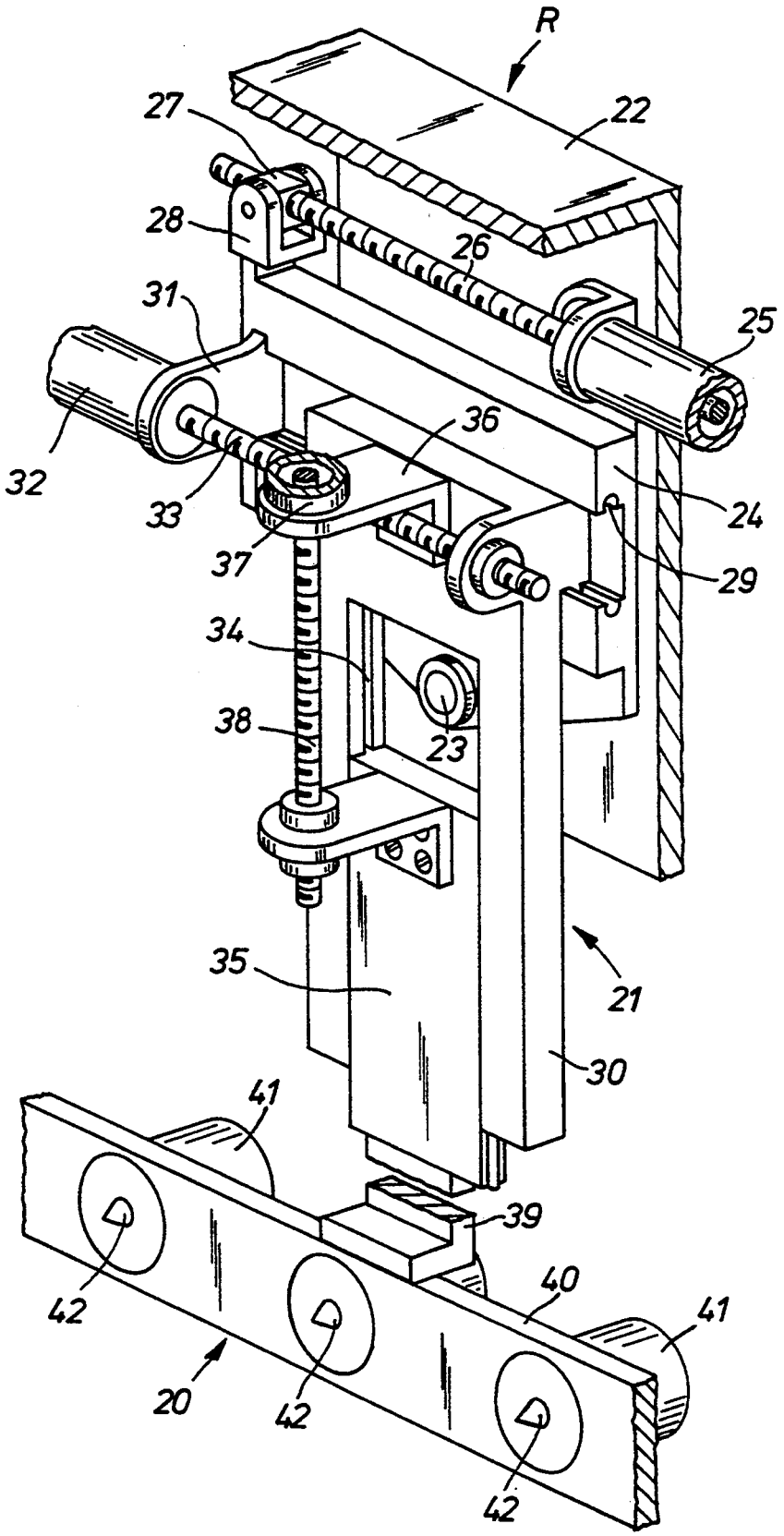
FIG. 7 is a partially cutaway representation of the aligning device in the scanning and aligning station.

An intermediate plate 19, is fastened vertically in the frame G and is opposed on both sides by a clamp 20, 20' each at a predetermined distance from and in the upper area of the intermediate plate 19. The intermediate plate 19 is associated with the scanning and aligning station R. By means of an aligning device 21 that is of a cross slide type, at least one of the clamps 20 and 20', which are of identical design is adjustable in two directions that are perpendicular to one another. These two directions are substantially in parallel to the plane of the intermediate plate 19. At least one of the clamps 20 and 20' is also pivotable around an axis that is perpendicular to the intermediate plate. The aligning device 21 will be explained in greater detail in connection with the clamp 20 on the basis of FIG. 7.

The aligning device 21 is accommodated within a housing 22 of the scanning and aligning station R. The housing is fastened to the frame G. A pin 23, which extends at right angles to the intermediate plate 19 and on which a support plate 24 is pivotably mounted, is fastened to the housing 22. A stepping motor 25, which is hinged to the housing 22 and is connected, via a threaded spindle 26 and a threaded block 27, to a bracket 28 which is a fixed component of the support plate 24. The stepping motor 25 is used to perform the pivoting movement of the support plate 24.

A slide 30, which is displaceable essentially in the horizontal direction, is accommodated in a guideway 29 of the support plate 24. The displacement of the slide 30 in relation to the support plate 24 is brought about by a stepping motor 32, which is fastened to a fixed stop 31 of the support plate 24 and is connected to the slide 30 via a threaded spindle 33.

A second slide 35 that is displaceable essentially in the vertical direction is accommodated in a guideway 34 of the slide 30. The displacement of the slide 35 in relation to the first slide 30 is brought about by a stepping motor 37, which is fastened to a fixed stop 36 of the first slide 30 and is connected to the second slide 35 via a threaded spindle 38.

The clamp 20, which has a horizontally extending clamp bar 40 and a plurality of pneumatic cylinders 41 arranged on it, is fastened to a projection 39 arranged at the lower end of the second slide 35. The number of the pneumatic cylinders 41 and the distances between them correspond to the number of the respective openings 15 and 16 in the respective grasping plates 5 and 7, as well as to the distance between the respective openings 15 and 16, respectively. The piston rods of the pneumatic cylinders 41, which are designated by 42, form clamping elements that will engage the workpiece layer W1. For engagement, the free ends of the piston rods 42 are made conical. By admitting pressure into the pneumatic cylinders 41, the workpiece layer W1 is pressed by the piston rods 42 against the intermediate plate 19 acting as an abutment, and held in a form-locking manner as a result. In order for the intermediate plate 19 not to be scratched by the movements of the tips of the piston rods 42, the pneumatic cylinders 41 are adjusted such that the tips of the piston rods 42 maintain a short distance from the intermediate plate 19 when pressure is admitted to the pneumatic cylinders 41.

It is thus possible to pivot the clamp 20 around a horizontal axis, which is determined by the pin 23, by means of the first stepping motor 25. The second stepping motor 32 makes it possible to displace the clamp 20 to and fro, and the third stepping motor 37 makes it possible to raise and lower the clamp 20.

An aligning device, which is designated by 21' is also associated with the clamp 20' in this embodiment. The aligning device 21' is identical to the above-described aligning device 21. Therefore, the same reference numerals were used for identical components if they are represented in the drawing, and the reference numerals for the aligning device 21' are distinguished from the reference numerals for the aligning device 21 by a prime sign.

Since a separate aligning device 21 or 21' is associated with each clamp 20 and 20', each of the two clamps 20 and 20' can consequently be linearly adjusted in two mutually perpendicular directions in relation to the respective other clamp 20' or 20, and also be pivoted in the plane defined by these two directions.

Figure 4:
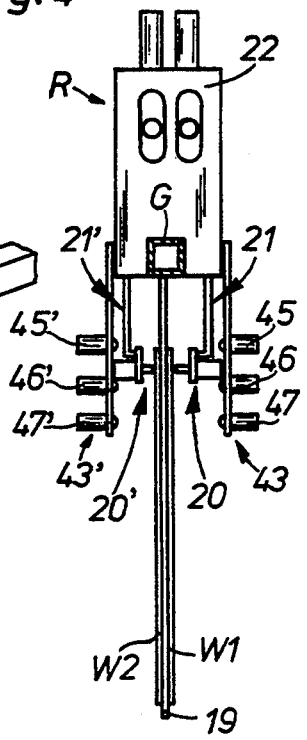
FIG. 4 is a front view of the scanning and aligning station with two workpiece layers held in it.

The scanning and aligning station R has one optical scanning device 43 and 43', respectively, for each workpiece layer W1 and W2. The optical scanning device 43 has three reflected light photocells 45, 46, and 47 (FIGS. 3 and 4), which are arranged on a support 44 and cooperate with the intermediate plate 19. The intermediate plate 19 is designed as a reflecting plate in this area. The optical scanning device 43' has the same design as the scanning device 43 and therefore also has three reflected light photocells 45', 46', and 47'.

The scanning devices 43, 43' are used for the point-by-point scanning of the workpiece layers W1 and W2 and consequently for detecting their instantaneous alignment position. The scanning devices 43 and 43' are connected to a control device (not shown) that processes their signals. The control device is also connected to the stepping motors, 25 and 25', 32 and 32', and 37 and 37' of the two aligning devices 21 and 21'. These stepping motors can be actuated and controlled, by the control device, as a function of the signals sent by the two scanning devices 43 and 43' in terms of mutual alignment of the contours of the workpiece layers W1 and W2.

The transport mechanism or means T shown in FIG. 1 is formed by an endless conveyer belt 48, which extends in a horizontal plane beneath the clamp 20, and runs around a drive wheel 49 and a deflecting wheel 50. The transport mechanism T' located on the other side of the intermediate plate 19 is identical to the transport mechanism T, so that the components of the transport mechanism T' are designated by the same reference numerals as those of the transport mechanism T, and only a prime sign is added to them.

To drive the two conveyor belts 48 and 48', a common motor 51 is provided, which is fastened to the frame G and is in drive connection with the shaft 52' of the drive wheel 49' shown in FIG. 2 A gear 53', which is in drive connection with a gear 53 fastened to the shaft 52 via a reversing gear 54 formed by two gears, is fastened to the shaft 52'. The two conveyor belts 48 and 48' are thus driven in opposite directions.

A deflecting wheel 56 mounted on a support 55 and, opposing this wheel, a deflecting wheel 58 mounted on a support 57, are arranged between two runs 48*a* and 48*b* of the conveyor belt 48 at a site between the scanning and aligning station R and the drive wheel 49. The transport mechanism T is subdivided by the deflecting wheels 56 and 58 into a first section T1 extending from the deflecting wheel 50 to the deflecting wheels 56 and 58 and a second section T2 extending from the deflecting wheels 56 and 58 to the drive wheel 49.

A pneumatic cylinder 59, whose piston rod 60 is hinged to a rod-shaped support 61, on which the deflecting wheel 50 is rotatably mounted, is pivotably mounted on the frame G. The pneumatic cylinder 59 makes it possible to pivot the first section T1 of the transport mechanism T back and forth between a carrying position adjacent to the intermediate plate 19 for carrying the workpiece layer W1 and a non-carrying position that is located farther away from the intermediate plate 19. The runs 48*a* and 48*b* can be pivoted around an axis that coincides with the longitudinal axis of the respective support 55 and 57. The first section T1' of the transport mechanism T' can also be pivoted back and forth by means of the pneumatic cylinder 59' in the same manner.

In the non-carrying position of the sections T1 and T1', the runs 48*a* and 48*a*' are at a sufficiently great distance from the intermediate plate 19, so that the grippers 4 and 4' together with the workpiece layers W1 and W2 can be pivoted unhindered into the area of the clamps 20 and 20'.

The runs 48*a* and 48*a*' of the conveyor belts 48 and 48' may be supported, if desired, on the rear side in the area of the two sections T1 and T2 as well as T1' and T2' in order to ensure the necessary holding effect on the workpiece layers to be transported. Such supporting, which can be brought about by, e.g., rail-like supports provided with pressure rollers, is not shown in the drawings for clarity's sake.

The sewing station N contains a sewing machine 62 that is fastened to a slide 63. The slide 63 is mounted on a vertically extending guide rail 64 and can be moved up and down by means of a chain drive 65. For accurate guiding of the workpiece layers to be sewn to one another, a guiding device 66 is arranged on the sewing machine 62. Such a guiding device is described in, e.g., West German Utility Patent No. DE-GM 85,16,184, hereby incorporated by reference, so that it is unnecessary to discuss it here in greater detail.

The device operates as follows:

Two workpiece layers W1 and W2 are placed on the supporting table 17 with the grippers 4 and 4' being in the pickup position according to FIG. 5, and the front edge of the workpiece layers W1 and W2 is flush with the discharge-side edge of the grasping plates 5 and 5'. The grasping plates 7 and 7' are subsequently pivoted downward toward the grasping plates 5 and 5', and as a result of which the workpiece layers W1 and W2 are clamped in the grippers 4 and 4' according to FIG. 1.

After the grippers 4 and 4' have grasped the workpiece layers W1 and W2, the arms 1 and 1' are pivoted upward around the axis A1, and the grippers 4 and 4' are pivoted around the axes A2 at the same time. The arms are pivoted so that the grippers 4 and 4' and the workpiece layers W1 and W2 will assume the position shown in FIG. 3. In order for the grippers 4 and 4' to be able to be moved unhindered into this position, the sections T1 and T1' of the transport mechanisms T and T' must be in the non-carrying position, i.e. removed from the intermediate plate 19, and the piston rods 42 forming the clamp elements must be withdrawn.

As soon as the grippers 4 and 4' reach the position shown in FIG. 3, pressure is admitted into the pneumatic cylinders 41 of the clamps 20 and 20' as a result of which their piston rods 42 will grasp the workpiece layers W1 and W2 through the openings 15, 16, 15' and 16' and fix them in cooperation with the intermediate plate 19. The grippers 4 and 4' are subsequently opened and pivoted into the pickup position shown in FIG. 5 to transfer the next workpiece layers.

After the workpiece layers W1 and W2 have been taken over by the clamps 20 and 20', the instantaneous position of the workpiece layers W1 and W2 is determined by means of the scanning device 43 and 43'. The angular position of the front, downwardly extending edge of the workpiece layers W1 and W2 is first measured by the reflected light photocells 46 and 47 as well as 46' and 47', and angular adjustment of the workpiece layers W1 and W2 is performed by energizing the stepping motor 25 and/or 25' in the case of deviations from the desired aligned position. The vertical and horizontal relative positions of the two workpiece layers W1 and W2 are subsequently determined by means of the reflected light photocells 45 and 47 as well as 45' and 47', and mutual alignment of the workpiece layers W1 and W2 is performed by energizing the corresponding stepping motors 32 and 37 as well as 32' and 37' in the case of a difference. The vertical and horizontal alignments are performed by simultaneously actuating the corresponding stepping motors 32 and 32' as well as 37 and 37' in opposite directions, as a result of which the time required for alignment is reduced to a minimum.

On completion of the mutual alignment of the workpiece layers W1 and W2, the sections T1 and T1' of the transport mechanisms T and T' are pivoted into the carrying position, while the motor 51 is still turned off. In the carry position, the sections T and T' grasp the workpiece layers W1 and W2 just below the clamps 20 and 20' in conjunction with the intermediate plate 19 acting as an abutment.

As soon as the transport mechanisms T and T' have grasped the workpiece layers W1 and W2, the clamps 20 and 20' are opened by releasing the pressure from the pneumatic cylinders 41, and the motor 51 is then turned on. After turning on the motors the workpiece layers W1 and W2 are together moved in the direction of the sewing station N, while their mutually aligned positions are maintained. The together workpiece layers W1 and W2 are then stopped in the sewing position by turning off the motor 51 after the sewing station has been reached.

As soon as the workpiece layers W1 and W2 have been transported beyond the contact points of the deflecting wheels 56 and 58 of the transport mechanism T and the corresponding contact points of the deflecting wheels (not shown) of the transport mechanism T' and are in the area of the second sections T2 and T2', the first sections T1 and T1' are again pivoted into the non-carrying position. It is thus possible to introduce the next workpiece layers into the scanning and aligning station R even at this point in time and to transfer the next workpiece layers to the clamps 20 and 20', so that time-overlapped, efficient operation is possible.

In the sewing position, the edge zones of the two workpiece layers W1 and W2, are to be sewn together, and the edge zones project slightly over the vertical edge of the intermediate plate 19 according to FIG. 2.

To carry out the sewing process, the sewing machine 62 is moved downward from the resting position shown in FIG. 1, and the projecting edge zones of the workpiece layers W1 and W2 are grasped by the guiding device 66. As soon as the sewing machine 62 reaches the upper edge of the workpiece layers W1 and W2, it is turned on After turning on, the sewing machine 62 forms an edge-parallel connection seam along a front longitudinal edge of the workpiece layers W1 and W2 in cooperation with the guiding device 66. Since the workpiece layers are held only in the area of their top transverse edge and hang down freely otherwise, the guiding device 66 being moved downward in the vertical direction along a straight path together with the sewing machine 62 is able to guarantee, due to corresponding transverse or pivoting movements of parts of the workpiece layers W1 and W2, edge-parallel sewing even in edge zones in which the course of the edge deviates from the vertical.

Embodiment 2

Figure 8:
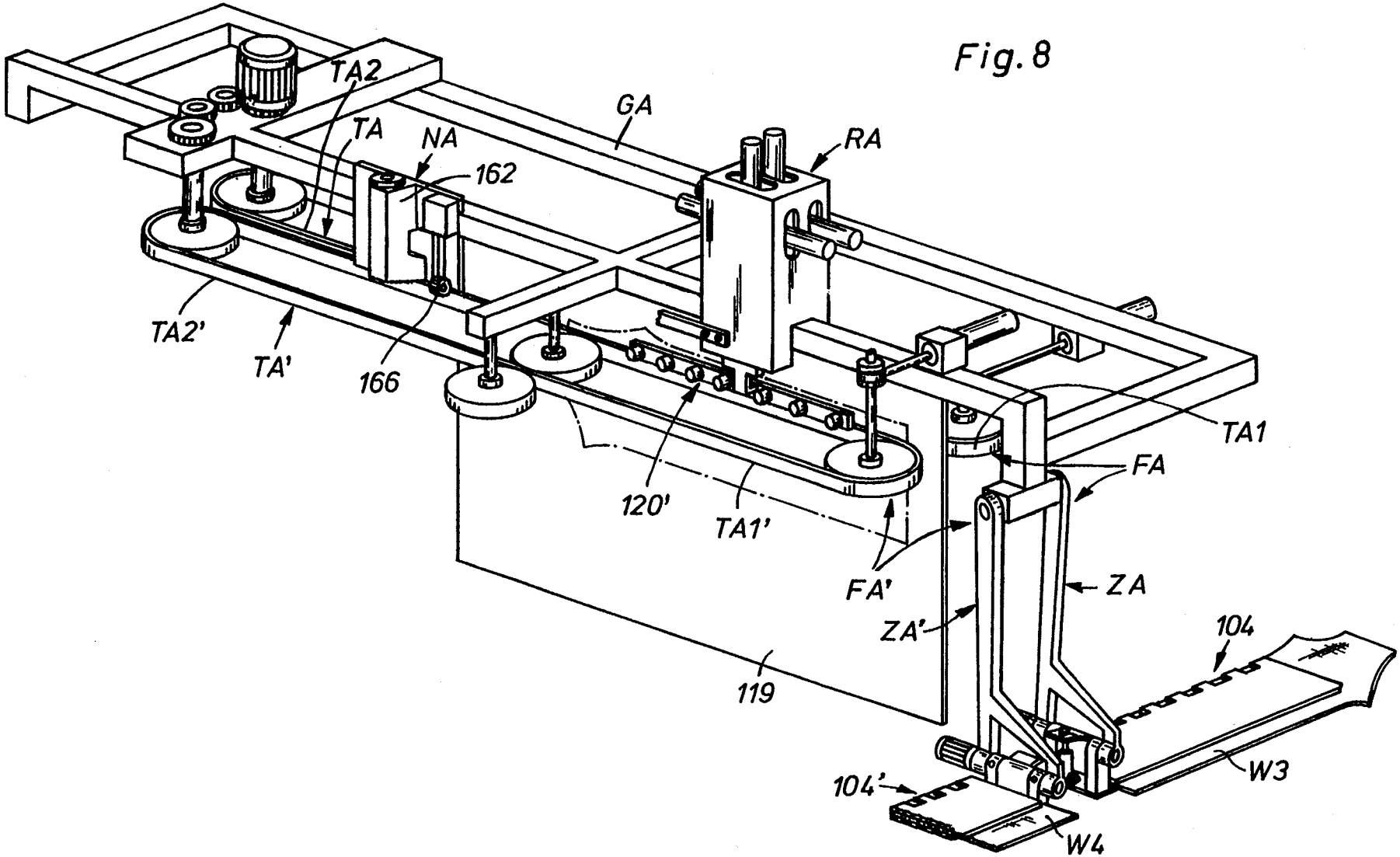
FIG. 8 is a representation, similar to FIG. 1, of a second embodiment of the present invention for handling workpiece layers, which are fed to a sewing machine along their longitudinal extension.

The embodiment shown in FIG. 8 pertains to a device in which the workpiece layers W3 and W4 are aligned hanging on a longitudinal side, rather than hanging on a narrow side, as in the case of the above-described device according to the first embodiment.

The device according to FIG. 8 has essentially the same design as the device according to FIGS. 1 through 7, and therefore it also consists of a frame GA, two conveying mechanisms FA and FA', a scanning and aligning station RA, as well as a sewing station NA. The conveying means FA and FA' likewise comprise one feed conveyor ZA and ZA', respectively, for feeding two workpiece layers W3 and W4 to the scanning and aligning station RA, as well as one transport mechanism TA and TA' each, respectively, for forwarding the aligned workpiece layers W3 and W4 to the sewing station NA.

The feed conveyors ZA and ZA' differ from the feed conveyors Z and Z' of the first embodiment solely by the greater length of the grippers 104 and 104', and the greater length is due to the fact that the grippers 104 and 104' grasp the workpiece layers W3 and W4 on a longitudinal side.

The aligning devices (not shown) of the scanning and aligning station RA are fully identical to the scanning and aligning station R according to the first embodiment. Only the clamps 120' (the opposite clamp is not shown) have been made wider, corresponding to the length of the longitudinal sides of the workpiece layers W3 and W4. The scanning devices (not shown) also must be adjusted to the special aligned position of the workpiece layers W3 and W4 in the same manner.

The transport mechanisms TA and TA' are also essentially identical to the transport mechanisms T and T' of the first embodiment, and are therefore also subdivided into first sections TA1 and TA1', which can be moved back and forth between a carrying position and a non-carrying position, and second sections TA2 and TA2'.

Only the sewing station NA does differ more substantially from the sewing station N, because the sewing machine 162 is provided with a guiding device 166 that is not movable, but is arranged stationarily on the frame GA Moreover it is also in a differently aligned position.

The modes of operation of the conveying means FA and FA' and of the scanning and aligning station RA are the same as those of the corresponding basic components of the first embodiment, so that it is unnecessary to discuss them in greater detail here.

There is a difference only in the manner in which the sewing process is carried out. Contrary to the first embodiment, the relative movement between the sewing machine 162 and the workpiece layers W2 and W4, which is necessary for seam formation, takes place here as a result of the fact that the transport mechanisms TA and TA' pulls the aligned workpiece layers W3 and W4 out of the scanning and aligning station in a continuous movement process. W3 and W4 are then moved together along the stationary sewing machine 62. This forms, in cooperation with the guiding device 166, an edge-parallel connection seam along the upper longitudinal edge. Since the seam is formed at a short distance from the transport mechanisms TA and TA' holding the workpiece layers W3 and W4, and the narrow strip of workpiece projecting over the transport mechanism TA and TA' is relatively inflexible, workpiece layers with straight or only slightly contoured edges can advantageously be processed with the device according to the second embodiment. For processing workpiece layers with highly contoured edges, it could be advantageous to arrange the sewing machine at right angles to the direction of feed and to control its distance from the course of the edge by the signals of an edge scanning device.

The transport mechanisms TA and TA' not only remove the workpiece layers W3 and W4 from the scanning and aligning station RA, but also perform the feed movement necessary for seam formation at the same time. The transport mechanisms TA and TA' are therefore not stopped during the sewing process, unlike in the first embodiment, and the next workpiece layers can be aligned in conjunction with the process according to which the first sections TA1 and TA1' are pivoted into a non-carrying position during sewing, in the scanning and aligning station already during this time. It is thus possible to work with a relatively rapid succession of workpiece layers with a time overlap.

While specific embodiments of the invention have been shown and described in detail to illustrate the application of the principles of the invention, it will be understood that the invention may be embodied otherwise without departing from such principles.

What is claimed is:

1. A process for bringing together and co-processing substantially horizontal first and second workpieces, the process comprising the steps of:

moving the first and second workpieces from a horizontal starting position to a vertical orientation at a scanning and aligning station by a conveying means;

said scanning and aligning station grasping the first and second workpieces from said conveying means;

scanning and aligning the first and second workpieces with each other at said scanning and aligning station;

providing a transport means for transporting said aligned first and second workpieces to a processing site, said transport means having a first section and a second section;

moving said first section to a non-carrying position when said conveying means is moving the first and second workpieces to said scanning and aligning station, and when said scanning and aligning station is scanning and aligning the first and second workpieces, in order to allow operation of said conveying means and said scanning and aligning station;

moving said first section to a carrying position after said scanning and aligning, to cause said first section to grasp the aligned first and second workpieces for said transporting to said processing site.

2. A process in accordance with claim 1, wherein:

said scanning and aligning is performed on an edge of the first and second workpieces;

said transferring of said aligned first and second workpieces by said transport means is along a direction substantially perpendicular to said aligned edge of said first and second workpieces; and stopping said first and second workpieces at said processing site; and connecting said stopped first and second workpieces with a stitch forming machine at said processing site.

3. A process in accordance with claim 1, wherein:

said scanning and aligning is performed on an edge of the first and second workpieces;

said transferring of said first and second workpieces by said transport means is along a direction substantially parallel to said aligned edge of said first and second workpieces; and transporting said aligned first and second workpieces through said processing site; and connecting said transported first and second workpieces with a stitch forming machine during said transporting of said aligned first and second workpieces through said processing site.

4. A process in accordance with claim 1, further comprising:

positioning said grasped first and second workpieces substantially flat opposite each other during said moving to said scanning and aligning station.

5. A process in accordance with claim 2, wherein:

said stitch forming machine performs said connecting on said edge of said stopped first and second workpieces.

6. A process in accordance with claim 3, wherein:

said stitch forming machine performs said connecting on said edge of said first and second workpieces during said transporting of said first and second workpieces through said processing site.

7. A process in accordance with claim 5, further comprising:

moving said stitch forming machine along said edge of said stopped first and second workpieces.

8. A process for bringing together and co-processing substantially horizontal first and second workpieces, the process comprising the steps of:

providing a substantially horizontal support table;

providing first and second arms pivotal at one end, each of said arms having a gripper at another end of said arms, said grippers having first and second plates;

positioning said first plate of said grippers substantially flush with a surface of said support table;

positioning the first and second workpieces in between said first and second plates of said grippers of said first and second arms respectively;

clamping the first and second workpieces in said grippers of said first and second arms respectively;

pivoting said first and second arms about said pivotal ends to move the clamped first and second workpieces to a scanning and aligning station;

pivoting said grippers during said pivoting of said arms to position the first and second workpieces substantially parallel to each other;

turning the first and second workpieces into a substantially vertical position during said moving;

scanning and aligning the first and second workpieces with each other at said scanning and aligning station;

transferring said aligned first and second workpieces to a processing site.

9. A process in accordance with claim 8, wherein:

said support table is provides with grooves, and said first plate of said grippers is positioned in said grooves for said flush positioning of said first plate with said surface of said support table.

* * * * *